US007475538B2

(12) United States Patent
Bishop

(10) Patent No.: US 7,475,538 B2
(45) Date of Patent: Jan. 13, 2009

(54) DIGITAL HYDRAULIC SYSTEM

(76) Inventor: Elton Daniel Bishop, 833 E. Thieme Dr., Fort Wayne, IN (US) 46802

( * ) Notice: Subject to any disclaimer, the term of this patent is extended or adjusted under 35 U.S.C. 154(b) by 58 days.

(21) Appl. No.: 11/564,065

(22) Filed: Nov. 28, 2006

(65) Prior Publication Data

US 2007/0120662 A1 May 31, 2007

Related U.S. Application Data

(60) Provisional application No. 60/740,345, filed on Nov. 29, 2005.

(51) Int. Cl.
*F15B 7/00* (2006.01)
*F15B 13/04* (2006.01)
*F01B 7/00* (2006.01)

(52) U.S. Cl. ..... 60/567; 60/583; 91/519; 92/152

(58) Field of Classification Search ..... 60/563, 60/567, 581, 583, 591, 593; 91/361, 519; 92/6 R, 152

See application file for complete search history.

(56) References Cited

U.S. PATENT DOCUMENTS

| | | | | | |
|---|---|---|---|---|---|
| 3,164,065 | A | | 1/1965 | Franz | 91/365 |
| 3,416,549 | A | | 12/1968 | Chaney et al. | 137/81.5 |
| 3,552,275 | A | | 1/1971 | Cheney et al. | 91/418 |
| 3,641,877 | A | | 2/1972 | Herbert | 91/44 |
| 3,796,132 | A | | 3/1974 | Panissidi | 91/167 |
| 5,058,384 | A | * | 10/1991 | Dunwoody | 60/567 |
| 5,062,268 | A | * | 11/1991 | Dunwoody | 60/567 |
| 5,197,285 | A | * | 3/1993 | Dunwoody | 60/567 |
| 5,218,997 | A | | 6/1993 | Dunwoody | 137/596.18 |
| 6,567,013 | B1 | | 5/2003 | Purkis et al. | 340/854.3 |
| 6,575,237 | B2 | | 6/2003 | Purkis et al. | 166/72 |
| 6,951,067 | B1 | * | 10/2005 | Dietz et al. | 91/361 |

* cited by examiner

*Primary Examiner*—Michael Leslie
(74) *Attorney, Agent, or Firm*—Taylor & Aust, P.C.

(57) ABSTRACT

A digital hydraulic system including a hydraulic source, a housing and a transtatic bridge. The transtatic bridge being substantially contained within the housing. The transtatic bridge being in fluid communication with the hydraulic source. The transtatic bridge communicating a force to or from a shaft or a fluid.

16 Claims, 9 Drawing Sheets

| MODE OF OPERATION | 8A | 4A | 2A | A | CUMULATIVE AREA |
|---|---|---|---|---|---|
| 1 | 0 | 0 | 0 | 0 | 0 |
| 2 | 0 | 0 | 0 | 1 | A |
| 3 | 0 | 0 | 1 | 0 | 2A |
| 4 | 0 | 0 | 1 | 1 | 3A |
| 5 | 0 | 1 | 0 | 0 | 4A |
| 6 | 0 | 1 | 0 | 1 | 5A |
| 7 | 0 | 1 | 1 | 0 | 6A |
| 8 | 0 | 1 | 1 | 1 | 7A |
| 9 | 1 | 0 | 0 | 0 | 8A |
| 10 | 1 | 0 | 0 | 1 | 9A |
| 11 | 1 | 0 | 1 | 0 | 10A |
| 12 | 1 | 0 | 1 | 1 | 11A |
| 13 | 1 | 1 | 0 | 0 | 12A |
| 14 | 1 | 1 | 0 | 1 | 13A |
| 15 | 1 | 1 | 1 | 0 | 14A |
| 16 | 1 | 1 | 1 | 1 | 15A |

DIGITAL HYDRAULIC SYSTEM

CROSS REFERENCE TO RELATED APPLICATIONS

This is a non-provisional application based upon U.S. provisional patent application Ser. No. 60/740,345, entitled "DIGITAL HYDRAULIC SYSTEM", filed Nov. 29, 2005.

BACKGROUND OF THE INVENTION

1. Field of the Invention

The present invention relates to a hydraulic system and method, and, more particularly, to a digital hydraulic system and method.

2. Description of the Related Art

Hydraulics has a history practically as old as civilization itself. Hydraulics, more generally, fluid power, has evolved continuously and been refined countless times into the present day state in which it provides a power and finesse required by the most demanding industrial and mobile applications. Implementations of hydraulic systems are driven by the need for high power density, dynamic performance and maximum flexibility in system architecture. The touch of an operator can control hundreds of horsepower that can be delivered to any location where a pipe can be routed. The positioning tolerances can be held within thousandths of an inch and output force can be continuously varied in real time with a hydraulic system. Hydraulics today is a controlled, flexible muscle that provides power smoothly and precisely to accomplish useful work in millions of unique applications throughout the world.

Most basic systems involve fluid drawn from a reservoir by a pump and forced through a shifted valve into an expandable chamber of a cylinder, which communicates with the work piece, ultimately performing a useful task. After the work is performed, the valve is shifted so the fluid is allowed back to the reservoir. The fluid cycles through this loop again and again. This is a simple on/off operation resulting in only two output force possibilities, zero or maximum. In many industrial and mobile hydraulic applications a dynamic variable force or variable displacement is required. This is accomplished with the use of throttling, a process whereby some of the high-pressure fluid is diverted, depressurized and returned to the reservoir. The use of such a diversion results in an output force at some intermediate point between zero and maximum. If a greater amount of fluid is allowed back to low pressure, the output force is lower. Conversely, if the amount of fluid allowed back to the low pressure portion of the system is less, then the output force is higher. Throttling, while being somewhat inefficient is highly effective.

Another widely implemented form of hydraulics is hydrostatics. A hydrostatic power transmission system consists of a hydraulic pump, a hydraulic motor and an appropriate control. This system can produce a variable speed and torque in either direction. Hydrostatic systems result in an increase in efficiency over the throttling method, but at a high initial expense. An extended control effort is required and response of a hydrostatic system is not as fast as with servo or proportional valves that may be used in a throttling operation.

What is needed in the art is an improved efficiency hydraulic system with a fast control response.

SUMMARY OF THE INVENTION

The present invention provides a digital hydraulic system including a hydraulic actuator, a digital hydraulic transformer and/or a digital hydraulic pump utilized in a system to controllably provide power.

The invention in one form is directed to a digital hydraulic system including a hydraulic source, a housing and a transtatic bridge. The transtatic bridge being substantially contained within the housing. The transtatic bridge being in fluid communication with the hydraulic source. The transtatic bridge communicating a force to or from a shaft or a fluid.

An advantage of the present invention is that it can be utilized in four quadrant operation.

Another advantage of the present invention is that it efficiently transforms mechanical power into hydraulic force and delivers the force with a minimal amount of energy loss.

Yet another advantage of the present invention is that it requires less cooling of the hydraulic fluid.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
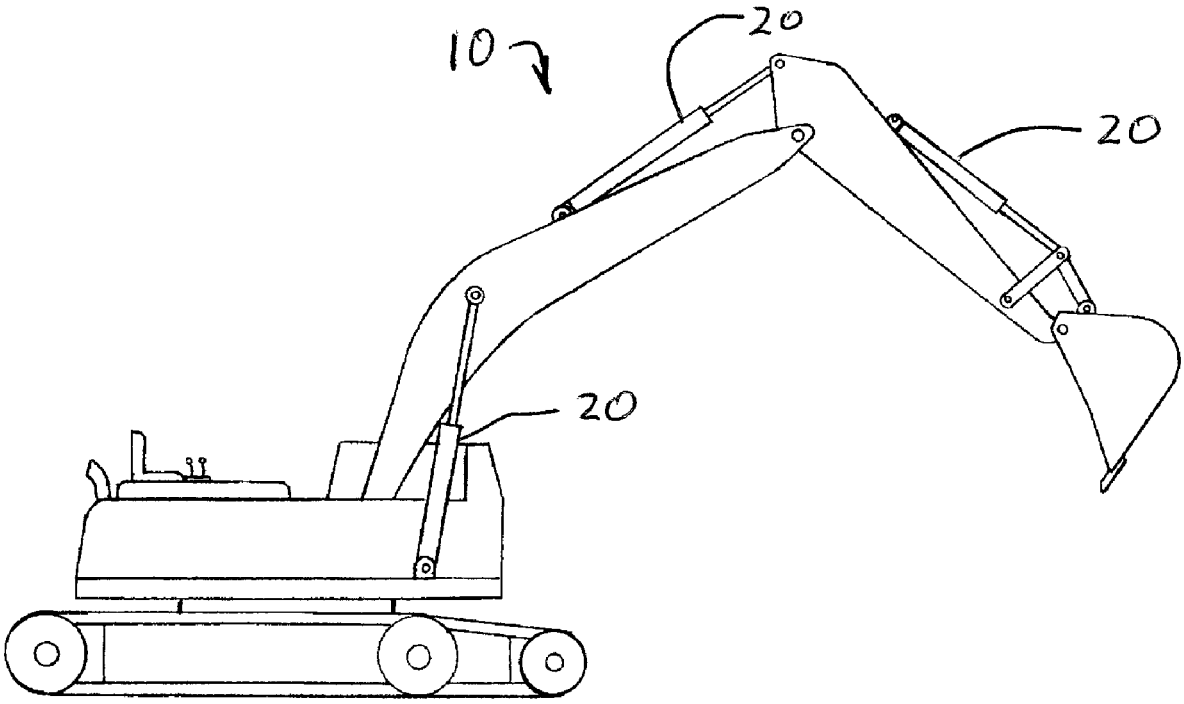
FIG. 1 illustrates a backhoe utilizing an embodiment of a digital hydraulic system of the present invention.
Figure 2:
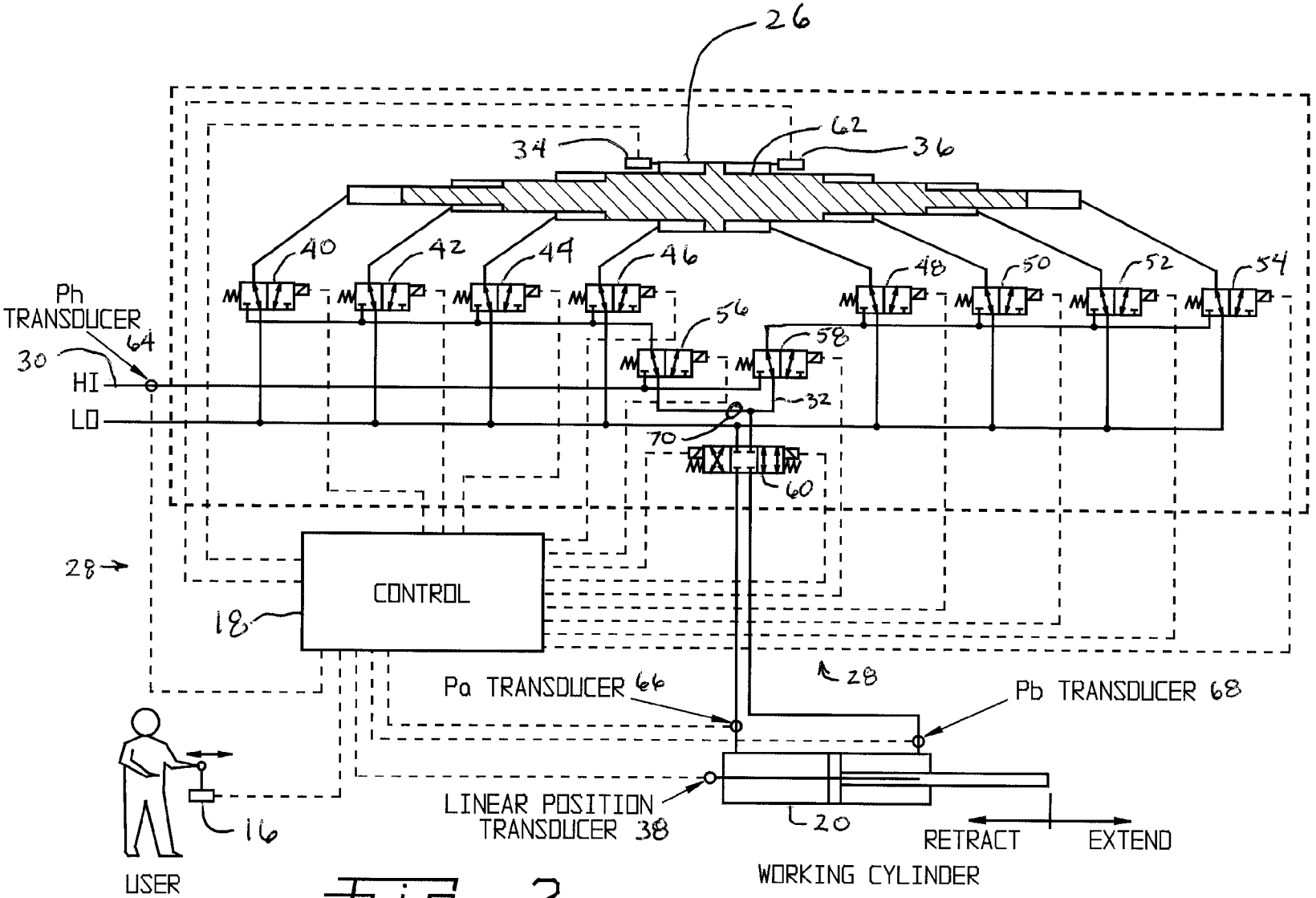
FIG. 2 is a schematical illustration of an embodiment of digital hydraulic system of the present invention.
Figure 3:
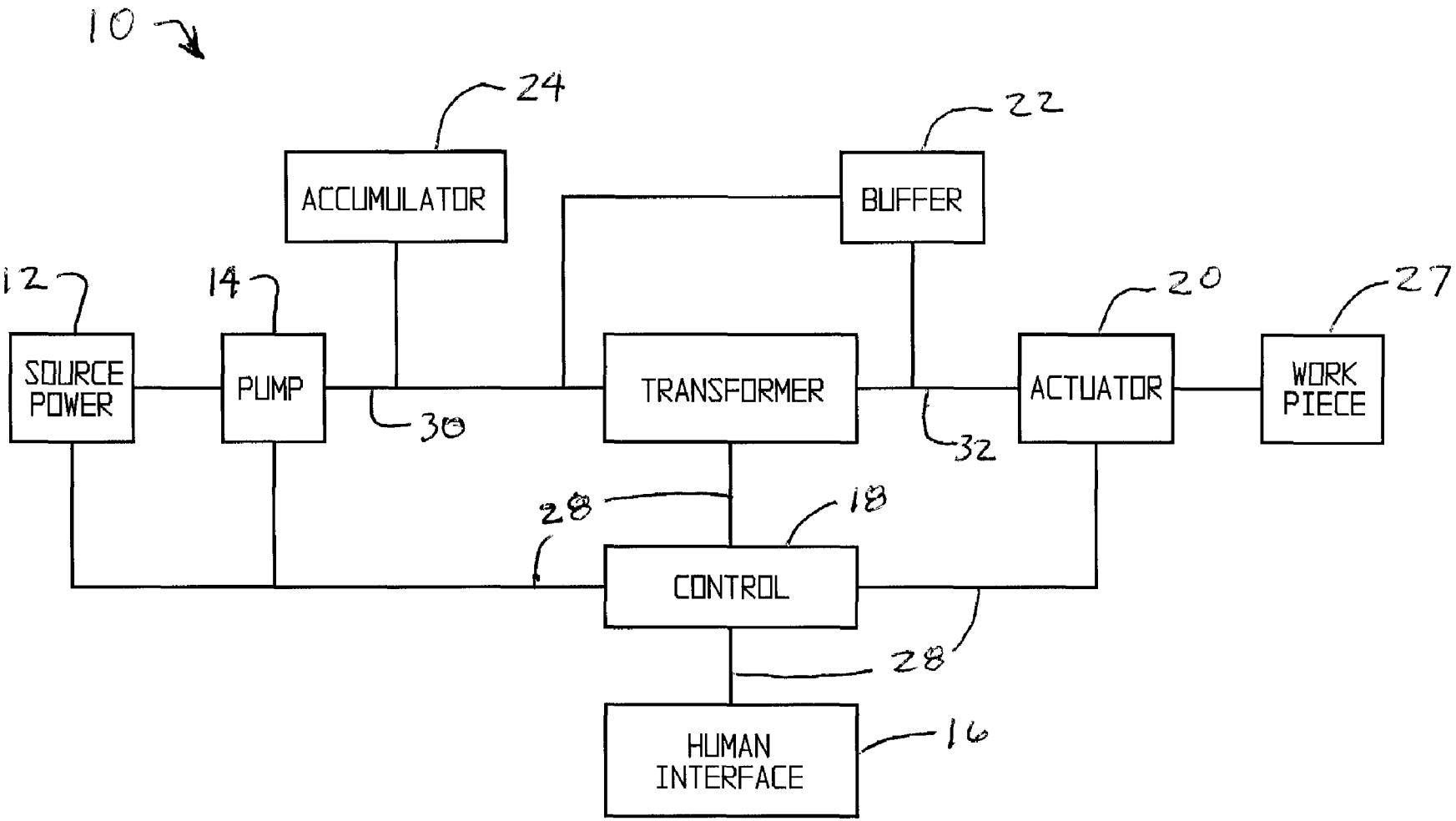
FIG. 3 is another schematical illustration of the digital hydraulic system of FIGS. 1 and 2.

Referring now to the drawings, and more particularly to FIGS. 1-3, there is shown a digital hydraulic system 10 being used in conjunction with a backhoe assembly. Digital hydraulic system 10 includes a power source 12, a pump 14, a human interface 16, a control system 18, an actuator 20, a buffering device 22, an accumulator 24, a digital hydraulic transformer 26, sense and control lines 28 and hydraulic lines 30 and 32. Power source 12 provides mechanical power to actuate pump 14 to serve as a hydraulic source to provide pressurized fluid/flow to digital hydraulic system 10. Pump 14 can be a typical hydraulic pump or may be a digital hydraulic pump 14 as described herein. Buffering device 22 serves an anti-cavitation function to absorb any impulses that may occur as the hydraulic fluid is switched by control system 18. Additionally, buffering device 22 may serve an accumulation function. Although not illustrated, pump 14 and actuator 20 may have buffering devices associated with each.

Human interface 16 can include a series of levers, to direct the operation of a piece of machinery, such as a backhoe. Human interface 16 is interactively connected with control system 18 to provide desired movement information from the operator to control system 18. Control system 18 communicates with human interface 16 as well as to pump 14, transformer 26 and actuator 20. Transformer 26 includes a transtatic bridge 62 that schematically appears as a stepped cylinder in FIG. 2 inside of a housing. Transtatic bridge 62 is not mechanically linked to anything outside of the housing and serves to transform a force against selected areas on one side to the fluid in other selected areas on the other side of transtatic bridge 62. Unlike transtatic bridge 62 of hydraulic transformer 26, the transtatic bridges that may be in pump 14 and/or actuator 20 may have a mechanical linkage that are respectively linked to a power source and a working piece.

Control system 18 can also receive information from power source 12 and send instructions to power source 12 to alter the function of power source 12. Control system 18 monitors pressure in accumulator 24. Control system 18 can alter the pressure/fluid flow from pump 14 based upon a need to move actuator 20. Further, control system 18 controls transformer 26 to adjust pressure in hydraulic line 32. Control system 18 also reacts to loads encountered by actuator 20 such that when movement by actuator 20 is in a direction that lowers the potential energy of a raised mass, such as a bucket full of dirt, then the lowering of the mass along with the weight of the mechanism can be used to increase the pressure in accumulator 24. In a like manner, control system 18 can utilize pressure on one side of transtatic bridge 62 to alter the pressure on another side of transtatic bridge 62. For example, if accumulator 24 has reached a maximum pressure and hydraulic line 32 has a less than a desired pressure, transtatic bridge 62 can translate pressure from accumulator 24 to provide energy to hydraulic line 32.

When human interface 16 indicates the movement of actuator 20 as desired, control system 18 actuates control valves based upon a calculated required pressure to be applied to actuator 20 in order to obtain the desired movement thereof. For example, if human interface 16 directs a work piece 27, which may be a tool 27, connected to actuator 20 to encounter an object that is to be pushed by movement of actuator 20, the position and movement of actuator 20 is monitored by control system 18 and appropriate pressure is supplied to hydraulic lines 32 by way of transtatic bridge 62, which draws energy from hydraulic line 30. So when tool 27 connected to actuator 20 encounters the object and human interface 16 indicates that tool 27 is to continue pushing, control system 18 detects either a slowed or stopped movement of tool 27 connected to actuator 20 and increases the pressure applied to actuator 20. Alternatively, actuator 20 is reconfigured by valves attached thereto to alter the pressurized cross-sectional area of actuator 20 to cause the tool to continue pressing against the encountered object. Control system 18 can balance the required pressure to be delivered from transtatic bridge, with that of cross-sectional area of actuator 20 so as to efficiently apply only the needed pressurized fluid in the required flow volume and pressure to cause the desired movement of actuator 20, based upon instructions from human interface 16.

For the sake of simplicity, a single pump and actuator control has been illustrated. However, the use of digital hydraulic components such as multiple actuators, transtatic bridges and/or pumps is also contemplated. Further, interaction of multiple control systems associated with selected sets of digital hydraulic components is also contemplated.

Figure 4:
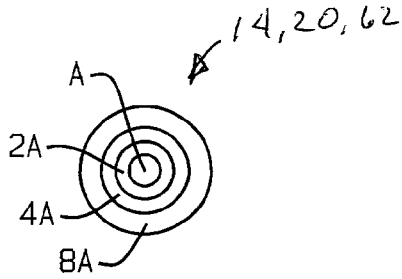
FIG. 4 is an illustrative table showing multiple operation modes of the digital hydraulic system of FIGS. 1-3.
Figure 4:
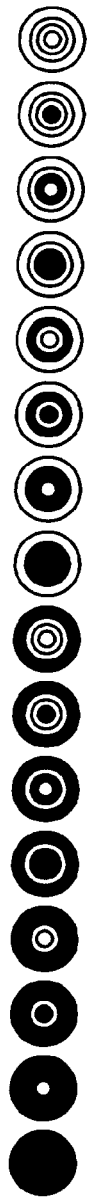

Now, additionally referring to FIG. 4, there is shown a schematic illustration of the operating of a transtatic bridge embodied here as a step cylinder having four separate cross-sectional areas, which illustratively yield sixteen combinations of operation available from the selection of portions of the active areas under pressure in transformer 26, actuator 20 and/or pump 14. For example, mode 1 illustrates that none of the area has been selected by control system 18. In mode 2, the smallest area is selected which is illustrated as the most central portion, which can indicate the pressures applied to the specified area. In mode three the area selected is twice area A and each stepped area is double the previous stepped area resulting in a binary digital hydraulic system. The selection of a desired cumulative area thereby directs the amount of pressure against a sealed piston to result in mechanical movement.

The following table illustrates how the mode of operation relates to the binary selection of areas of a digital cylinder/piston arrangement of the present invention. The cumulative area relates to the ratio of the pressure of the high pressure line that is transferred. In transtatic bridge 62 of hydraulic transformer 26 the ratios are selectable on both sides so as to allow 143 unique overall ratios of pressure conversion. This is assuming that the areas on each side of transtatic bridge 62 are substantially the same. It is possible to have the two sides of transtatic bridge 62 to not be mirror images of each other, but for the ease of illustration such is illustrated and described herein. The transtatic bridge of actuator 20 may have a different total area than transtatic bridge 62 and if it has four selectively pressurized sections as discussed herein, then the overall possibilities of unique power selections exceed 2,000. Differing numbers of pressurized sections and working area sizes are contemplated as a part of the present invention.

| MODE OF OPERATION | 8A | 4A | 2A | A | CUMULATIVE AREA | RATIO | TRANSFOM PRESSURE |
|---|---|---|---|---|---|---|---|
| 1 | 0 | 0 | 0 | 0 | 0 | 0:15 | 0 |
| 2 | 0 | 0 | 0 | 1 | A | 1:15 | Ph/15 |
| 3 | 0 | 0 | 1 | 0 | 2A | 2:15 | 2*Ph/15 |
| 4 | 0 | 0 | 1 | 1 | 3A | 3:15 | 3*Ph/15 |
| 5 | 0 | 1 | 0 | 0 | 4A | 4:15 | 4*Ph/15 |
| 6 | 0 | 1 | 0 | 1 | 5A | 5:15 | 5*Ph/15 |
| 7 | 0 | 1 | 1 | 0 | 6A | 6:15 | 6*Ph/15 |

-continued

| MODE OF OPERATION | 8A | 4A | 2A | A | CUMULATIVE AREA | RATIO | TRANSFOM PRESSURE |
|---|---|---|---|---|---|---|---|
| 8 | 0 | 1 | 1 | 1 | 7A | 7:15 | 7*Ph/15 |
| 9 | 1 | 0 | 0 | 0 | 8A | 8:15 | 8*Ph/15 |
| 10 | 1 | 0 | 0 | 1 | 9A | 9:15 | 9*Ph/15 |
| 11 | 1 | 0 | 1 | 0 | 10A | 10:15 | 10*Ph/15 |
| 12 | 1 | 0 | 1 | 1 | 11A | 11:15 | 11*Ph/15 |
| 13 | 1 | 1 | 0 | 0 | 12A | 12:15 | 12*Ph/15 |
| 14 | 1 | 1 | 0 | 1 | 13A | 13:15 | 13*Ph/15 |
| 15 | 1 | 1 | 1 | 0 | 14A | 14:15 | 14*Ph/15 |
| 16 | 1 | 1 | 1 | 1 | 15A | 15:15 | 15*Ph/15 |

As can be seen in FIG. 2, transtatic bridge 62 is located within stepped cavities having hydraulic flow lines connected by way of valves. For the sake of illustration, position sensors 34 and 36 are associated with transtatic bridge 62 and position sensor 38 is associated with actuator 20, herein illustrated as a simple dual acting cylinder. Valves 40, 42, 44 and 46 are associated with one side of transtatic bridge 62 and valves 48, 50, 52 and 54 are associated with an opposite side of transtatic bridge 62. Valves 56 and 58 allow for the switching of the high pressure line to opposite sides of transtatic bridge 62. Valve 60 allows for the reversed application of pressure to reach the actuator cylinder. Additionally valve 60 may be kept in a closed position until pressure, as measured by pressure sensor 70 is at the proper level to be applied to actuator 20.

As illustrated in FIG. 2, transtatic bridge 62 may be utilized to step the pressure up from the pressure contained in the high pressure line or step it down. For example, if the actuator is commanded to extend by the user in operation of human interface 16, control 18 would sense the command and cause valve 60 to shift to the right thereby connecting the low pressure line to the right side of the working cylinder and the left side of the working cylinder being connected to an output of transtatic bridge 62. For the lowest level of pressure, valve 40 is shifted to the left and valves 48, 50, 52 and 54 are likewise shifted to the left and valve 56 is shifted to the left thereby completing the fluid circuit to cause fluid flow from the high pressure line through valve 56 and valve 40, which would represent a mode 2 operation on the left side of transtatic bridge 62. The mode on the right side of transtatic bridge 62 would be in a mode 16 thereby causing the pressure of the fluid flowing to the left side of the actuator to be $1/15^{th}$ of the pressure in the high pressure line. As can be understood, the selective positioning of valves 40, 42, 44 and 46 alter the amount of pressure driving transtatic bridge 62 and the selective use of valves 48, 50, 52 and 54 on the opposite side of transtatic bridge 62 selects the desired output pressure to be applied to the actuator when valves 56 and 58 are so positioned. Numerous combinations then of output pressure are available by the selective use of valves 40-54. When transtatic bridge 62 approaches either position sensor 34 or 36, valves 56 and 58 can be simultaneously reversed from their position along with an appropriate reversal of valves 40-54 so that when transtatic bridge 62 travels in an opposite direction it still supplies the desired pressure of hydraulic fluid to the actuator. Pressure sensors 64, 66, 68 and 70 provide information to control system 18 to optimally control the function of transtatic bridge 62.

Understanding of the control of transtatic bridge 62 allows for an easy understanding of transtatic bridge 118 of single acting actuator 100 having valves 102, 104, 106 and 108 that are hydraulically connected with pressure cylinders 110, 112, 114 and 116, respectively. Pressure cylinders 110-116 are illustrated in schematic form and have stepped progressions, which for purposes of illustration can be understood to equate to the binarily oriented sixteen modes of FIG. 4 although different increments are also contemplated. Actuator 100 is connected to high and low hydraulic lines, which can come directly from the pump, an accumulator or from the pressure created by transtatic bridge 62. For ease of illustration the actual source of the pressure is not shown. The position of actuator 100 is detected by a position sensor, not shown, and when a new position is desired control system 18 selectively activates one or more of valves 102, 104, 106 and 108. For example, for the least amount of force from actuator 100, only valve 108 is activated causing the high pressure line to be directed to pressure cylinder 116. In a like manner, as described above, combinations of the activation of valves 102-108 apply hydraulic fluid to a selected cross sectional area of actuator 100. This tailoring of fluid connections allows the selected pressure cylinders to efficiently move shaft 120 of actuator 100 without relying upon a throttling method or dropping pressure through a flow rate reducer, which is common in the industry. The more efficient use of a pressurized hydraulic source by the present invention reduces the amount of energy required from power source 12 to operate hydraulic system 10 as compared to current hydraulic systems.

Figure 5:
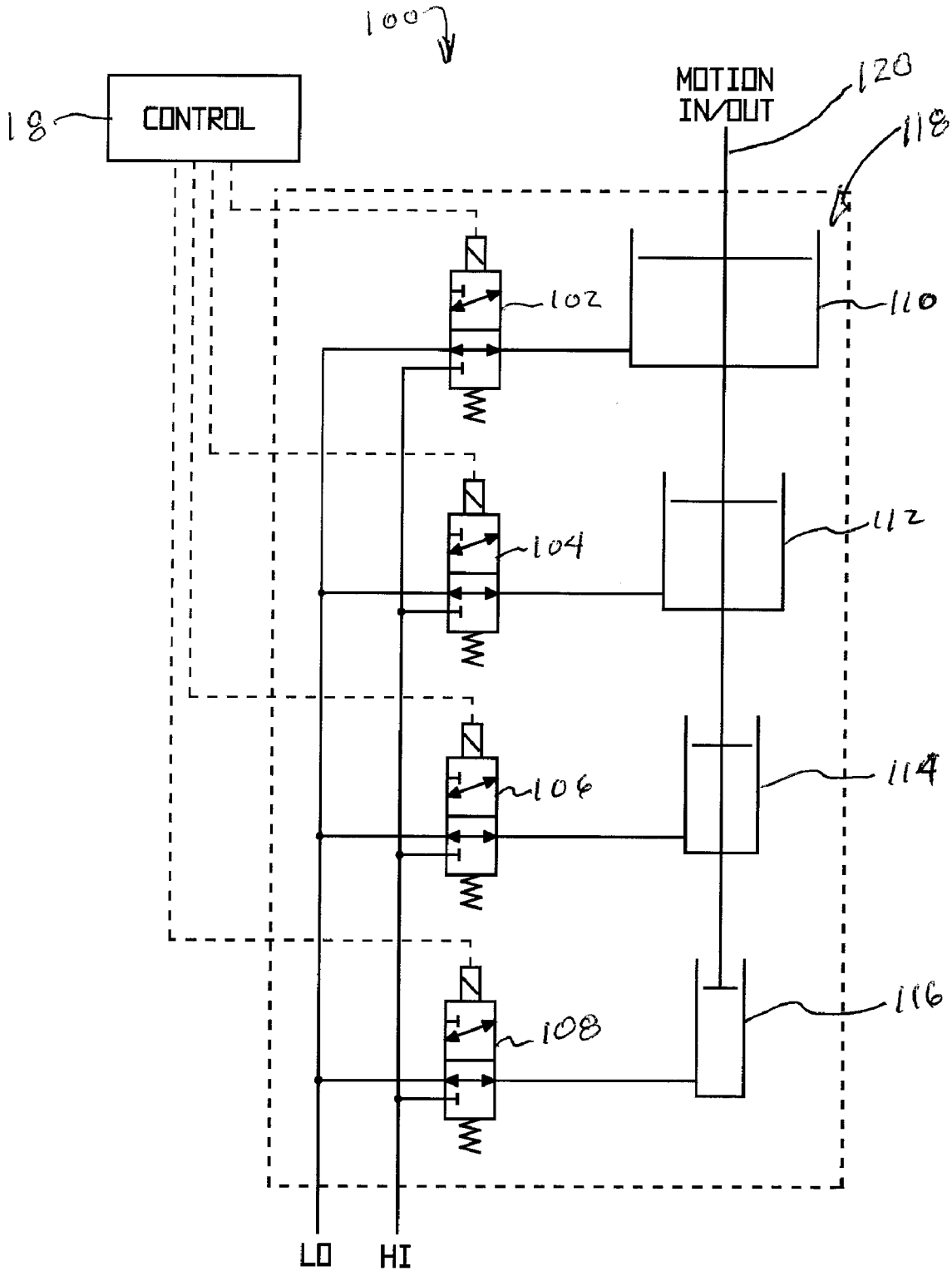
FIG. 5 is a schematical illustration of an actuator/pump used by the digital hydraulic system of FIGS. 1-3.
Figure 6:
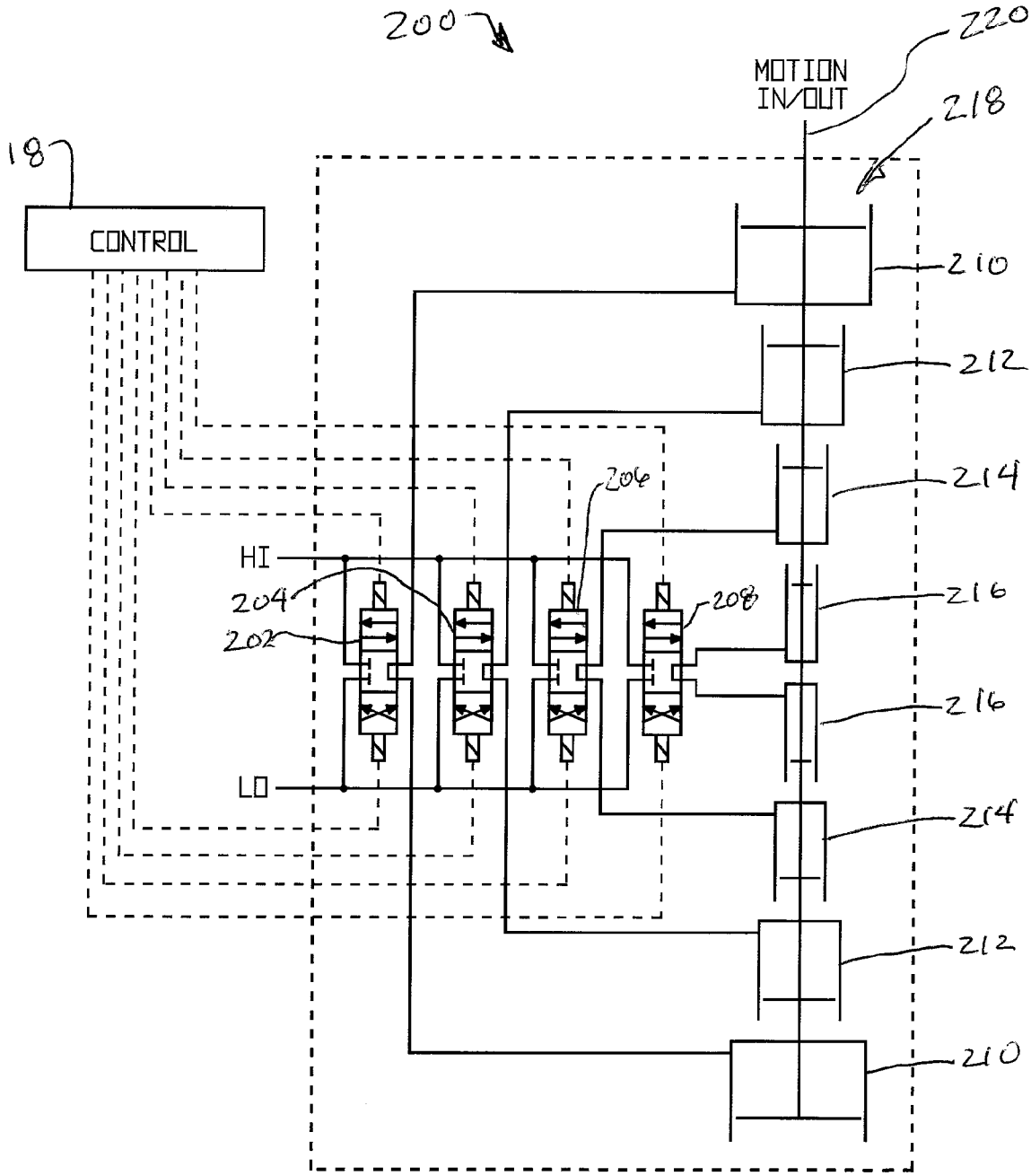
FIG. 6 is a schematical illustration of a double acting actuator/pump usable by the hydraulic system of FIGS. 1-3.

Now, additionally referring to FIG. 6, there is shown a double acting actuator 200 having valves 202, 204, 206 and 208 operatively connected to opposing pressure cylinder pairs 210, 212, 214 and 216 of transtatic bridge 218. The selective actuation of valves 202-208 cause a powered movement in both directions for reasons similar to those explained relative to FIG. 5. A shaft 220 may be attached to transtatic bridge 218 to convey force into/out of actuator 200.

Figure 7:
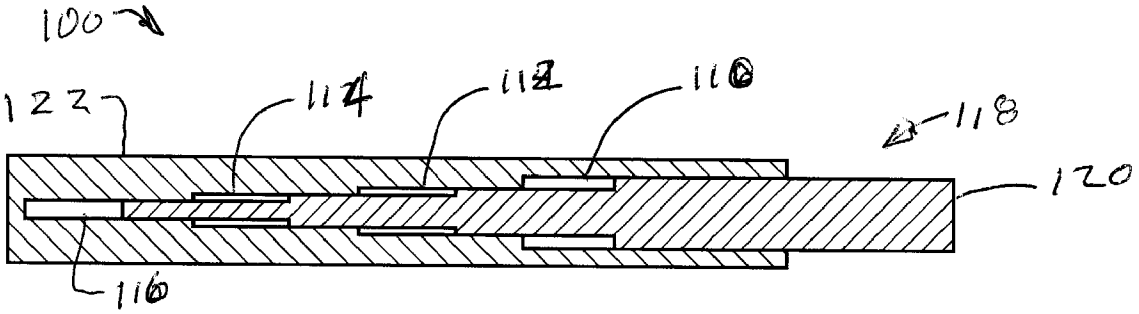
FIG. 7 is a schematical cross-sectional view of single acting pump/actuator of FIG. 5.
Figure 8:
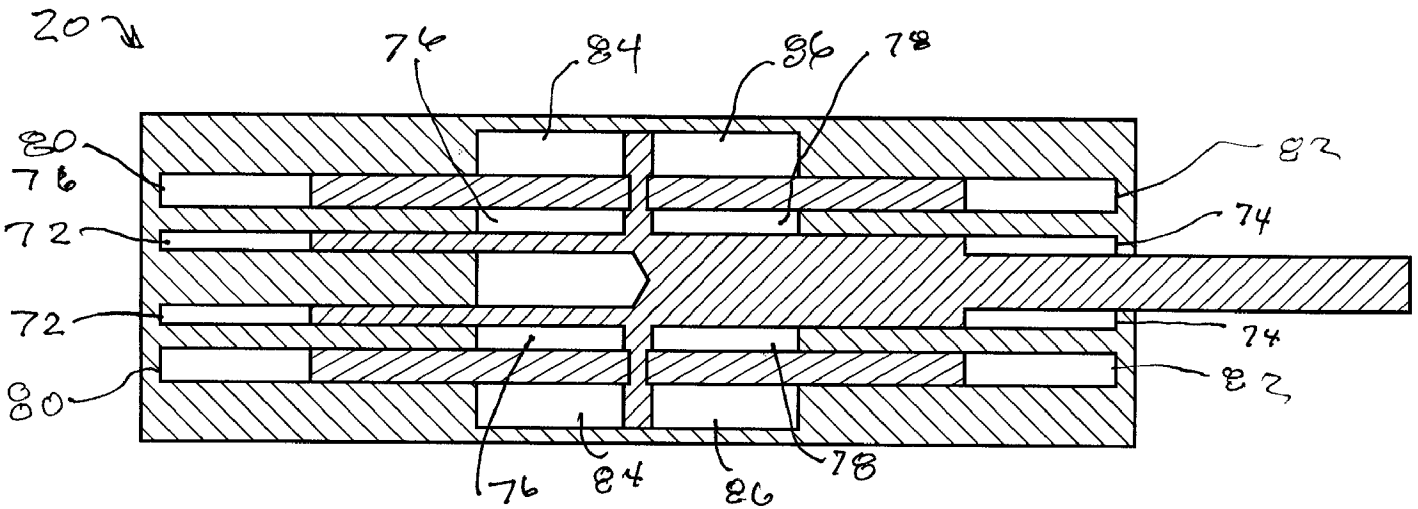
FIG. 8 is a cross-sectional schematical illustration of a double acting pump/actuator of FIG. 6.

Two cross-sectional examples are provided in FIGS. 7 and 8 to show how different pressurized cavities can be utilized to produce an actuator/pump in accordance with the present invention. The pressurized cavities of FIG. 7 correspond nicely with the end view presented in FIG. 4 and the schematical presentation in FIG. 5, showing four separate pressurized areas. These areas can be separately pressurized to cause the movement of shaft 120 within housing 122. In FIG. 8, another embodiment of an actuator 20 or 200 having a geometry that again has working areas that are selectively pressurized and which are annular in nature. For example, working area 72 is opposite matched working area 74 on the opposite end thereof. In a like manner area 76 is opposite 78, area 80 is opposite area 82 and area 84 is opposite area 86. The selective pressurization of different sides of working areas 72-86 modify the direction and force applied to the shaft extending from actuator 20. The annular geometry of FIG. 8 is again binarily related with the working areas being associated by a factor of two.

Figure 9:
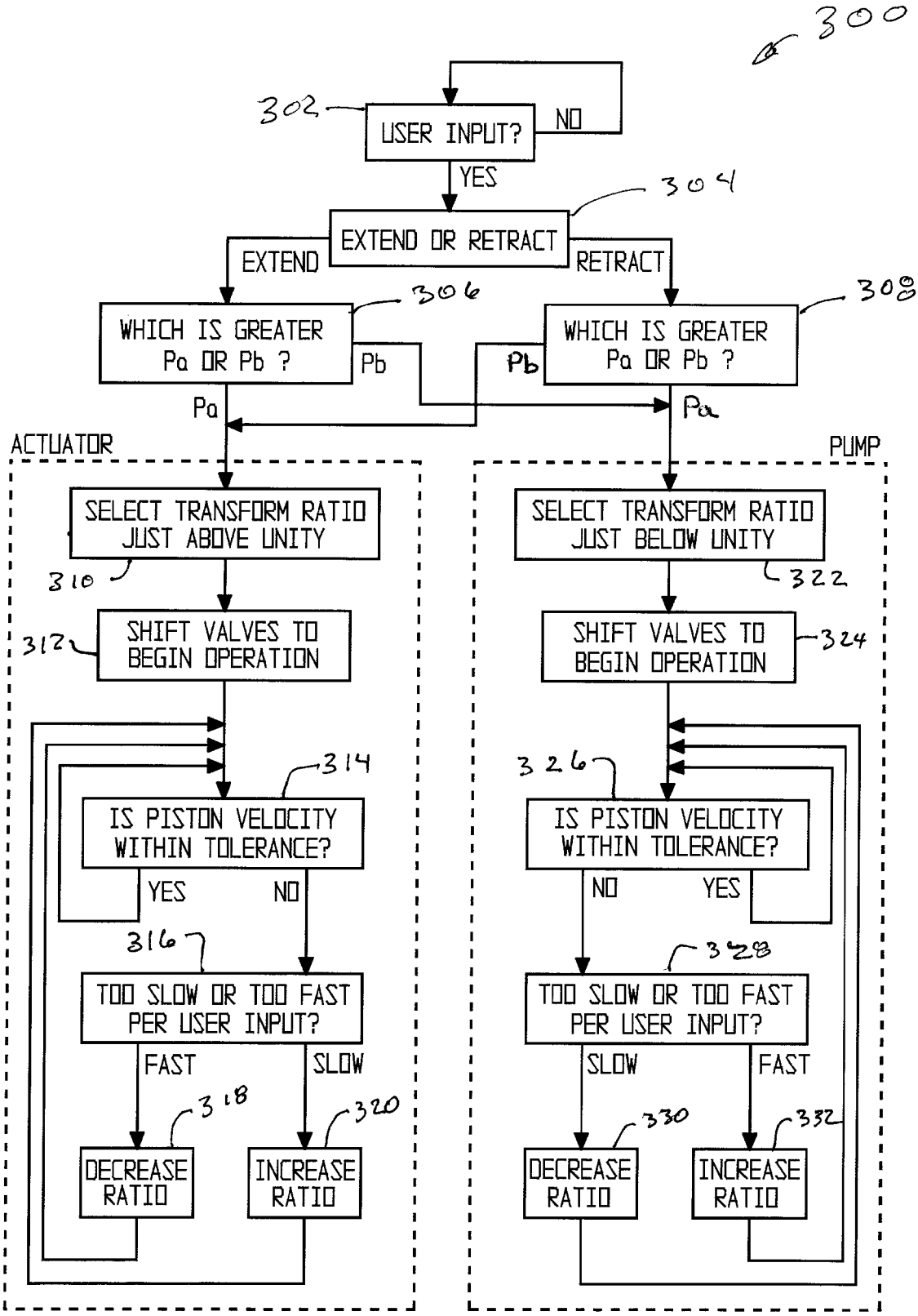
FIG. 9 is a schematical flow diagram of a control method utilizing the digital hydraulic system of FIGS. 1-8.

Now, additionally referring to FIG. 9 is an illustrative method 300 that utilizes the digital features of hydraulic system 10. A user input is detected at step 302 and the direction is selected at step 304 as to whether actuator 20 should extend or retract. If the command from the user is to extend actuator 20, then the method proceeds to step 306. If the command from the user is to retract actuator 20, then the method proceeds to step 308. Steps 306 and 308 are similar in that a determination is made as to which side of the working cylinder has the largest pressure. If at step 306 the largest pressure is detected at transducer Pb then actuator/pump 20 functions as a pump to increase the pressure in an accumulator 24. If at step 306 if pressure is greater at transducer Pa then actuator/pump 20 functions as an actuator. Continuing along the flow of Pa being greater than Pb then a transform ratio is selected for the valves to be actuated at step 310. At step 312 the valves are engaged causing the operation to begin. If the piston velocity is within a predetermined tolerance then no action is taken at step 314. However, if the piston velocity is not within a predetermined tolerance then an indication of the position as it changes with time is determined at step 316 to determine if the piston velocity is too slow or too fast as compared to the required user input detected at step 302. If the movement is too fast then the transform ratio is decreased at step 318. If it is determined that movement of the actuator is too slow then the transform ratio is increased at step 320 by selectively engaging valves similar to step 312.

In a like manner if the pressure detected by the Pb transducer is greater than Pa then actuator 20 functions as a pump thereby recovering energy from the movement of the load held by actuator/pump 20. In a manner somewhat similar to the functioning of an actuator the transform ratio is selected just below unity at step 322, which means that the actuator will then retract. Valves are shifted to begin the operation at step 324 and the movement is monitored at step 326 to determine if the piston velocity is within a predetermined tolerance. If the piston velocity is not within tolerance then a determination is made at step 328 as to whether the piston velocity is too slow or too fast as compared to the input required by the user at step 302. If the movement is too slow then the transform ratio is reduced at step 330 and valves are reoriented similar to step 324 to alter the velocity of the piston. If at step 328 it is determined that piston velocity is too fast then the transform ratio is increased, thereby causing increased resistance to movement of the actuator, thereby increasing pressure in accumulator 24.

Figure 10:
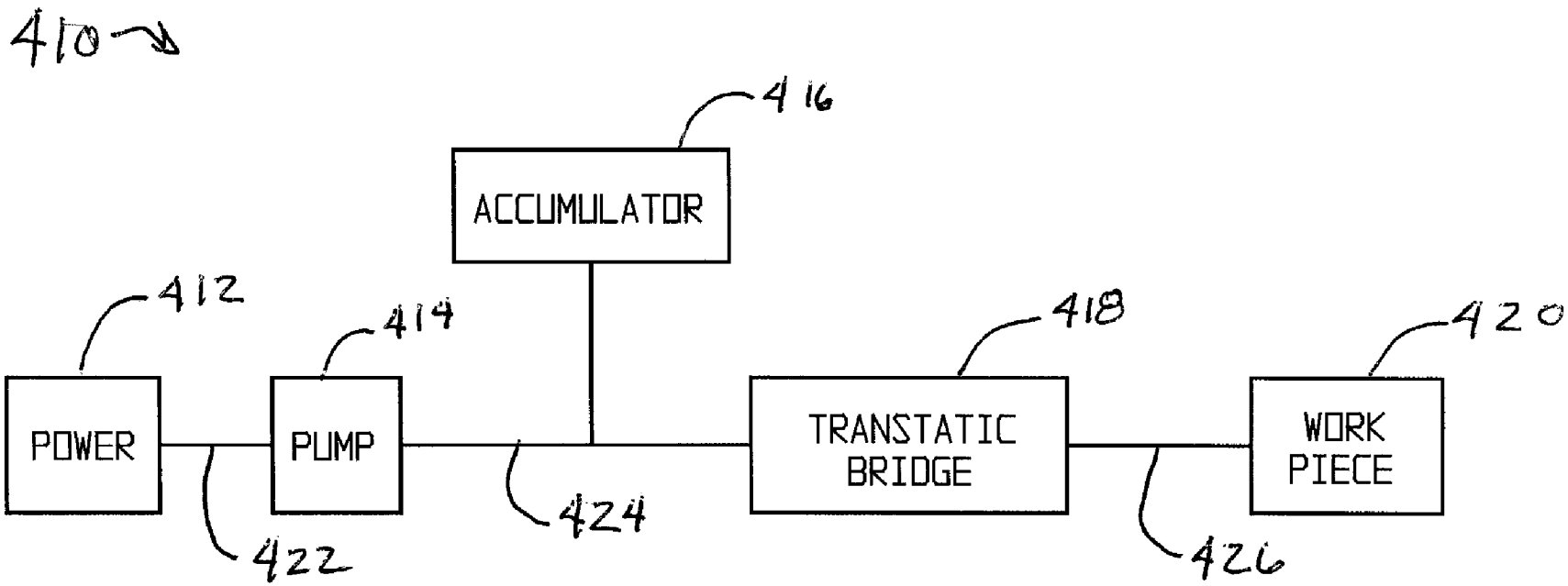
FIG. 10 is another embodiment of a digital hydraulic system of the present invention.

Now, additionally referring to FIG. 10, there is shown another embodiment of the present invention including digital hydraulic system 410 including a power source 412, a pump 414, an accumulator 416 and a transtatic bridge 418 operatively connected to a work piece 420. The prime mover that provides mechanical work to the system is power source 412, which is mechanically linked by linkage 422 to pump 414. Pump 414 is a hydraulic source of pressure and flow, and may be a digital pump 14 as described herein being under the control of a system that selects portions of a transtatic bridge within pump 14 to control the flow and pressure delivered to hydraulic line 424. Accumulator 416 stores and releases pressurized fluid by way of hydraulic line 424. Transtatic bridge 418 is a transtatic bridge as described above and may be single or double acting. A linkage 426 may be a mechanical linkage 426 such as a shaft 426 that is connected to work piece 420 for the controllable movement thereof. Alternatively, linkage 426 may be a fluidic linkage that provides fluid pressure/flow to work piece 420. For the sake of simplicity the valves and control system associated with system 410 have not been shown but would include the control and valve elements described herein to direct force to/from work piece 420.

Pump 14 again can be identical or substantially identical with an actuator 20 in its construct and control by control system 18. Pump 14 can be also known as a variable displacement linear pump (VDLP) 14, which can displace a variable amount of fluid per unit length of stroke or allow variable stroke per unit of volume displaced. Its function depends upon how it is plumbed and controlled, that is, whether a constant force on the piston or a constant fluid pressure is required from the VDLP. Considering that virtually any low frequency random oscillating motion could be harnessed as a usable energy source, many applications are possible for the VDLP beyond the energy supplied by way of a typical power source, such as an internal combustion engine. One potential application of the VDLP of the present invention could be a shock absorber on a vehicle, such as an automobile or bus. The device, when utilized in such an application, would displace a progressively larger amount of fluid per unit length of stroke as the velocity of the piston increases. This would function to cause greater resistance to motion and a greater fluid displacement as the piston velocity increases. Whenever a powerful random motion has to be damped or the need for an extreme hydraulic efficiency is present, the VDLP can be utilized to transform motion to a usable pressurized hydraulic flow. Digital hydraulic systems of the present invention allow a new flexibility of design applications.

In a like manner a variable displacement linear actuator (VDLA) 20 may deliver a variable force output throughout its stroke with near instantaneous control response and near perfect efficiency as compared to conventional hydraulic systems. The double acting variable displacement linear actuator permits four quadrant operation, in which operational transition is seamless throughout the entire range of motoring and pumping. For example, a four quadrant linear actuator can produce a variable force in either direction while moving in either direction at nearly any velocity. If a control signal is sent by way of control system 18 to actuator 20 to produce some specific force in a particular direction and the opposing force of the load against it is less, the opposition force is overpowered, and the mechanism, along with the load, accelerate in the direction of the actuator force. If however, the opposing force of the load is greater than the force output of the VDLA, the mechanism and load travel in an opposite direction thereby causing the VDLA to operate as a VDLP.

The digital hydraulic transformer (DHT), converts hydraulic energy by way of transtatic bridge 62. An input flow at a given pressure can be converted to an output flow at another pressure level with minimal loss. The conversion is also reversible, as the product of the input pressure and flow is equal to the product of output pressure and flow. The transtatic bridge in pump 14 is connected to power source 12 to mechanically move the transtatic bridge so that the selectable flow and pressure of the working hydraulic fluid from pump 14 is produced. In a like manner, particularly since actuator 20 and pump 14 can be substantially similar, the transtatic bridge of actuator 20 can be connected to a work piece or load, so that the selected flow and pressure of the hydraulic fluid directed to the transtatic bridge determines the force applied to the work piece. Transtatic bridge 62 of hydraulic transformer 26 is not mechanically linked to a motive force or to a load. Rather transtatic bridge 62 serves to transfer one force-flow product to another force-flow product.

In operation the digital hydraulic system of the present invention may present discrete pressures and flows, which may be altered by an interpolation method to provide a pressure and/or flow that is between the discrete selections. The interpolation methods include frequency modulation by the control system to vary the selection of adjacent discrete pressures/flows to provide a selection between the discrete outputs. Similarly a pulse width modulation technique can be used to interpolate the pressure/flow. Additionally, a servo valve, a throttling technique and/or a modulation of a poppet valve is contemplated to slightly alter a discrete output.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A digital hydraulic system, comprising:

fluid at high pressure;

fluid at low pressure;

a hydraulic actuator;

a digital hydraulic transformer including:

a fixed element having a first end and a second end; and a reciprocating element having a first end and a second end, said fixed element and said reciprocating element operating along a common axis, said first end of said fixed element and said first end of said reciprocating element, and said second end of said fixed element and said second end of said reciprocating element defining sets of cooperating pairs of pistons and cavities adapted to cooperate to thereby define two pluralities of variable volume working chambers, each of said pluralities of variable volume working chambers including a first working chamber, a second working chamber and a third working chamber, each of said working chambers having a surface area substantially normal to said common axis, said surface area of said first working chamber being related to said surface area of said second working chamber by a factor of approximately two, said surface area of said second working chamber being related to said surface area of said third working chamber by a factor of approximately two, said surface area of said first working chamber being related to said surface area of said third working chamber by a factor of approximately four; and a control system including:

means to selectively fluidically connect each of said variable volume working chambers to one of said fluid at high pressure, said fluid at low pressure, and said hydraulic actuator; and means to ensure a continuous flow of hydraulic fluid in communication with said hydraulic actuator regardless of a direction of movement of said reciprocating element with respect to said fixed element.

2. The digital hydraulic system of claim 1, wherein said fixed element and said reciprocating element are substantially bilaterally symmetric.

3. The digital hydraulic system of claim 1, wherein said control system further includes:

means for detecting the position of said reciprocating element with respect to said fixed element, and means for reversing the direction in which said reciprocating element is moving with respect to said fixed element.

4. The digital hydraulic system of claim 1, wherein said fixed element, said reciprocating element and said variable volume working chambers are substantially cylindrical and are arranged coaxially.

5. The digital hydraulic system of claim 1, wherein said hydraulic actuator is a double acting actuator having at least two ports.

6. The digital hydraulic system of claim 5, wherein said control system further includes means to selectively fluidically connect each of said at least two ports to a corresponding one of said selected variable volume working chambers and said fluid at low pressure.

7. The digital hydraulic system of claim 1, further including:

at least one additional digital hydraulic transformer; and at least one additional hydraulic actuator, each of said at least one additional digital hydraulic transformer being connected in parallel to said fluid at high pressure and said fluid at low pressure, each of said at least one additional digital hydraulic transformer being in fluid communication with a corresponding one of said at least one additional hydraulic actuator.

8. The digital hydraulic system of claim 1, further comprising an accumulator in fluid communication with said fluid at high pressure.

9. The digital hydraulic system of claim 1, wherein said control system further comprises:

a first pressure sensor in fluid communication with said fluid at high pressure, said first pressure sensor being configured to provide an input to said control system; and a second pressure sensor in fluid communication with fluid in said hydraulic actuator, said second pressure sensor providing an input to said control system.

10. The digital hydraulic system of claim 1, wherein said control system further includes:

means for detecting the position of said reciprocating element with respect to said fixed element; and means for reversing the direction in which said reciprocating element is moving with respect to said fixed element, said fixed element and said reciprocating element being bilaterally symmetric.

11. The digital hydraulic system of claim 10, wherein said fixed element, said reciprocating element and said variable volume working chambers are substantially cylindrical and are arranged coaxially.

12. The digital hydraulic system of claim 11, wherein said hydraulic actuator is a double acting actuator having at least two ports.

13. The digital hydraulic system of claim 12, wherein said control system further includes means to selectively fluidically connect each of said at least two ports to a corresponding one of said selected variable volume working chambers and said fluid at low pressure.

14. The digital hydraulic system of claim 10, further including:

at least one more digital hydraulic transformer; and at least one more hydraulic actuator, each of said at least one more digital hydraulic transformer being connected in parallel to said fluid at high pressure and said fluid at low pressure, each of said at least one more digital hydraulic transformer being in fluid communication with a corresponding one of said at least one more hydraulic actuator.

15. The digital hydraulic system of claim 14, further including an accumulator in fluid communication with said fluid at high pressure.

16. The digital hydraulic system of claim 15, wherein said control system further comprises:

a first pressure sensor in fluid communication with said fluid at high pressure, said first pressure sensor being configured to provide an input to said control system; and a second pressure sensor in fluid communication with fluid in said hydraulic actuator, said second pressure sensor providing an input to said control system.

* * * * *